US007241258B2

(12) United States Patent
Miller, III et al.

(10) Patent No.: US 7,241,258 B2
(45) Date of Patent: Jul. 10, 2007

(54) PASSIVE VIBRATION ISOLATION OF IMPLANTED MICROPHONE

(75) Inventors: Scott Allan Miller, III, Lafayette, CO (US); Bernd Waldmann, Boulder, CO (US); Travis Rian Andrews, Loveland, CO (US); David L. Basinger, Loveland, CO (US); Jose' H. Bedoya, Boulder, CO (US); James Roy Easter, Lyons, CO (US); James Frank Kasic, II, Boulder, CO (US); Douglas Miller, Parker, CO (US)

(73) Assignee: Otologics, LLC, Boulder, CO (US)

( * ) Notice: Subject to any disclaimer, the term of this patent is extended or adjusted under 35 U.S.C. 154(b) by 342 days.

(21) Appl. No.: 10/983,102

(22) Filed: Nov. 5, 2004

(65) Prior Publication Data

US 2005/0197524 A1 Sep. 8, 2005

Related U.S. Application Data

(60) Provisional application No. 60/518,479, filed on Nov. 7, 2003, provisional application No. 60/518,255, filed on Nov. 7, 2003.

(51) Int. Cl.
*H04R 25/00* (2006.01)

(52) U.S. Cl. ..... 600/25; 381/71.2; 181/175

(58) Field of Classification Search ..... 600/25; 607/136–137, 55–56; 181/128–129, 148, 181/151, 157–158, 175; 381/312–315, 322–329, 381/71.1–71.4

See application file for complete search history.

(56) References Cited

U.S. PATENT DOCUMENTS 6,137,889 A * 10/2000 Shennib et al. ..... 381/328
6,456,654 B1 * 9/2002 Ginesi et al. ..... 375/229
2005/0101830 A1 * 5/2005 Easter et al. ..... 600/25

* cited by examiner

*Primary Examiner*—John P. Lacyk
(74) *Attorney, Agent, or Firm*—Marsh Fischmann & Breyfogle LLP

(57) ABSTRACT

A system for reducing the vibration sensitivity of an implantable microphone without an equal or greater reduction in sound sensitivity. The system reduces non-ambient vibrations by placing at least one compliant member into the path of transmission for tissue-borne vibration, but not into the path for ambient sound-induced vibration. More particularly, a compliant member is interposed along the path between a source of non-ambient vibration and an implanted microphone. In one aspect, a compliant base member is disposed between an implanted microphone and an implant wearer's skull. In another aspect, a microphone is compliantly suspended relative to an implant housing using a support membrane. In either aspect, the compliant member (i.e., base member and/or membrane) and the supported member (i.e., housing and/or microphone) define a supported system having a natural or resonant frequency. This natural frequency may be set to a value to advantageously isolate the microphone against transmitted vibration.

65 Claims, 12 Drawing Sheets

PASSIVE VIBRATION ISOLATION OF IMPLANTED MICROPHONE

CROSS REFERENCE TO RELATED APPLICATIONS

This application claims priority under 35 U.S.C. 119 to U.S. Provisional Application No. 60/518,479 entitled: "Passive Vibration Isolation of Implanted Microphone Assembly," having a filing date of Nov. 7, 2003; and U.S. Provisional Application No. 60/518,255 entitled: "Passive Vibration Isolation of Implanted Hearing System Capsule," having a filing date of Nov. 7, 2003, the contents of which are incorporated herein as if set forth in full.

FIELD OF THE INVENTION

The present invention relates to implanted microphones, e.g., as employed in hearing aid systems and, more particularly, to implanted microphones having reduced sensitivity to undesired sources of vibration.

BACKGROUND OF THE INVENTION

In the class of hearing aid systems generally referred to as implantable hearing instruments, some or all of various hearing augmentation componentry is positioned subcutaneously on or within a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and transducer, are located subcutaneously. In either arrangement, an implantable transducer is utilized to stimulate a component of the patient's auditory system (e.g., ossicles and/or the cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate, which causes the ossicular chain to stimulate the cochlea through its natural input, the so-called oval window.

As may be appreciated, hearing instruments that propose utilizing an implanted microphone will require that the microphone be positioned at a location that facilitates the receipt of acoustic signals. For such purposes, an implantable microphone may be positioned (e.g., in a surgical procedure) between a patient's skull and skin, typically at a location rearward and upward of a patient's ear (e.g., in the mastoid region). For a wearer of such a hearing instrument (e.g., middle ear transducer or cochlear implant stimulation systems), undesirable vibration (e.g., non-sound vibration) originating within the user's skull and/or tissue may be detected and amplified by the microphone to an undesirable degree. For instance, a middle ear transducer used with a hearing instrument may create such vibration. In this case, detection and amplification of the vibration can lead to objectionable feedback. Unwanted vibration can also arise naturally from talking or chewing. In both cases, undesired vibrations are transmitted through the user's skull or tissue to the site of the implanted microphone where a component of these undesired vibrations may be received by a microphone diaphragm and where the skin and tissue covering such a microphone diaphragm may undesirably increase the overall vibration sensitivity of the system. In this regard, while proposed implantable hearing aid instruments are sensitive to the sources of undesired vibration, they are intended by design to be sensitive to "ambient" sound vibrations from outside a user's body.

It is therefore desirable to have a means of reducing system response to sources of non-ambient (i.e., undesired) vibration, without affecting the desired ambient sound vibration sensitivity.

SUMMARY OF THE INVENTION

In order to reduce non-ambient vibration sensitivity without an equal or greater reduction in ambient sound vibration sensitivity, it is necessary to attenuate the non-ambient vibrations received by an implanted microphone preferentially. The present invention accomplishes this goal by placing at least one compliant member into the transmission path of tissue borne/non-ambient vibrations (e.g., vibrations transmitted via bone and/or soft tissue), but not into the transmission path for ambient sound-induced vibrations. For discussion purposes, the invention is primarily set forth in relation to reducing tissue-borne/non-ambient vibrations in systems where a microphone is attached to a patient's skull. However, it will be appreciated that the microphone may be implanted at locations other than the skull of a patient. For instance, a microphone may be implanted on the neck or chest of a patient. In such an application, non-ambient vibrations caused by the heart, muscle movement, and/or clothing may be present. Irrespective of the location of an implanted microphone, what is important is that the compliant member be operative to attenuate non-ambient vibrations having a component that is directed substantially normal to the surface of an implanted microphone diaphragm.

In one arrangement, the compliant member may be interposed along the path between a patient's bone and a microphone mounted to that bone. In this regard, the compliant member may act as an isolating suspension/support for a microphone, thereby changing the natural, or resonant, frequency of the suspended system that includes, at a minimum, the compliant member and the microphone.

This natural frequency may be set to a value advantageous in isolating the microphone against sources of non-ambient vibration. Preferably, the compliant member is selected so that the suspended system has a natural, or resonant, frequency that is less than the lowest frequency of non-ambient vibration to be attenuated (e.g., about 100 Hz). It is more desirable that the natural frequency be less than ½ the lowest frequency in the frequency range to be attenuated. It is still more desirable that the natural frequency be less than ⅕ the lowest frequency in the frequency range to be attenuated. For example, when the natural frequency of the suspended system is ⅕ that of the lowest frequency to be attenuated, transmission of that frequency will be reduced to $1/24^{th}$ its original value. In this way, the present invention reduces the system's sensitivity to non-ambient vibrations, while preserving its sensitivity to ambient vibrations (e.g., desired sound vibrations).

In instances where tissue-borne vibrations are of primary concern, the source of the tissue-borne vibration will determine the frequency range to be attenuated. Two such sources, and their associated frequency ranges to be attenuated by the present invention, will be described.

First, tissue-borne vibration caused by a middle ear stimulation transducer may be transmitted back to the microphone creating a possibility for feedback. The resonance/response of the stimulation transducer is controlled by the design of the stimulation transducer itself. It is also known that the skin and skull of the patient transmits some frequencies better than others. Therefore, the range of frequencies for feedback mitigation purposes is generally the audio band of 20 Hz to 20 kHz. However, as a practical matter, this is to be balanced by the expected output of the transducer. Most hearing aid devices limit response to frequencies below 10 KHz and often do not address sounds below 250 Hz. Therefore, a range of 250 Hz to 10 KHz is expected. A practical implementation however, will likely concentrate on even more specific ranges. Typically, a patient or group of patients will need more transducer output at a specific range of frequencies, for example 2 KHz to 4 KHz.

Second, tissue-borne vibration caused by biological sources such as chewing and speech are dominated by more low frequency content. These vibrations may be attenuated or shaped to specific levels for a "natural" sound. This range of interest is approximately 250 Hz to 3 KHz.

In one aspect, a system for isolating an implantable hearing aid microphone from non-ambient vibrations (e.g., non-desired vibrations) is provided. The system includes an implant housing, a microphone and a first compliant member for disposition between a source of non-ambient vibration and the implant housing and/or the microphone. The microphone may be supportably interconnected relative to the implant housing such that a diaphragm of the microphone is located to receive ambient sound vibrations. Accordingly, the first compliant member may be disposed to at least partially isolate the microphone from non-ambient vibrations, which may facilitate the receipt of incident ambient sound-vibrations.

Various refinements exist of the features noted in relation to the subject aspect of the present invention. Further features may also be incorporated in the subject aspect as well. These refinements and additional features may exist individually or in any combination. For instance, the microphone may include a diaphragm, a transducer and a microphone housing (e.g., for holding the diaphragm and transducer relative to one another) However, the microphone may also include additional componentry such as, without limitation, multiple diaphragms and/or multiple transducers, which may include any of a variety of electroacoustic transducers. Likewise, the implant housing may also house (e.g., hermetically) other hearing instrument componentry such as, without limitation, a processor(s), circuit componentry, and a rechargeable energy storage device(s) etc. The implant housing may further provide one or more signal terminal(s) for electrical interconnection (e.g., via one or more cables) to, for example, an implantable transducer for a middle ear stimulation device or a cochlear stimulation implant. An example of a middle ear stimulation transducer is described in U.S. Pat. No. 6,491,622, and is hereby incorporated by reference.

In one application, the first compliant member may be formed as a compliant base member adapted to be disposed between the implant housing and a patient's bone, (e.g., the patient's skull). In one arrangement, the compliant base member may be adapted to engage an outside surface of the implant housing. Likewise, the implant housing may be sized for supported engagement by the compliant base member. In this regard, the compliant base member may have a first cup-shaped surface to matingly receive the implant housing. Further, another surface of the compliant base member may be shaped to conformally engage a patient's bone across the lateral extent thereof.

When the compliant base member is substantially cup-shaped, a peripheral rim of the compliant base member may be tapered, or beveled, from an outer edge of a bone-facing side to an edge of a receiving-recess on an opposite side (i.e., the cup-shaped side). In this regard, the compliant base member may provide a distributed surface for the support of skin overlying the implant, reducing discomfort and the potential or reduced circulation.

The compliant base member may be formed in part or entirely of an elastomeric material. Further, the compliant base member may be of a single-piece construction. For example, the compliant base member may consist of a molded elastomeric material selected from a non-inclusive list including one or more of the following: a silicone elastomer, a polybutadiene, a polychloroprene, a polyethylene, a polyisobutylene, a polyisoprene, a polymethyl-methacrylate (PMMA), and polyurethane. Irrespective of the material utilized to form the compliant base member, to be sufficiently compliant for vibration isolating/reducing purposes, the selected material will typically have a Shore durometer hardness of no more than about 60. Further, it will be noted that the thickness of the compliant base member may be selected in combination with material hardness for vibration isolating/damping purposes. Typically, the thickness across the extent of the base member that is disposed beneath the implant housing will be between about 2 mm and 6 mm and, more preferably, about 4 mm.

In order to improve the attenuation properties of the compliant base member, one or more additives may be added to the material forming the base member. For instance, dispersion of solid materials, such as titanium flakes, throughout the matrix of the base member (e.g., during base formation) may allow the base member to reflect/redirect a portion of received vibration energy and thereby reduce the amount of non-ambient vibration energy that is received by the implant housing. Alternatively or in addition, compressible gases may be added to the matrix of the compliant base member. In this regard, bubbles may be formed within the matrix, or, gas filled glass beads may be mixed therein. In either case, such voids may be operative to reflect non-ambient vibrations passing through the base member and thereby dampen/attenuate such vibrations.

In another application, the first compliant member is defined by a support membrane that may be disposed about a portion of the microphone and which may suspend the microphone. For instance, a first portion of such a support membrane may be interconnected to the microphone and a second portion of the support membrane may be interconnected to the implant housing.

In one embodiment, the support membrane is disposed about a portion of the microphone. For example, an inside perimeter of an aperture within such a support membrane may extend about the entirety of the periphery of the microphone while an outside perimeter of the support membrane may be interconnected to the implant housing. Accordingly, the support membrane may be of a single-piece construction. Alternatively, a plurality of separate membrane sections may be spaced (e.g., equally spaced) about the periphery of the microphone. In this instance, a first edge of each membrane section may be interconnected to the microphone while a second edge (e.g., an opposing edge) is interconnected to the implant housing. In any case, the microphone may be supportably and/or sealably suspended by the compliant support membrane(s) within an opening of the implant housing. In this regard, a diaphragm of the microphone may be located to receive ambient sound vibrations and a microphone transducer of the microphone may be disposed (e.g., hermetically sealed) within the implant housing. Such suspended arrangement may allow the microphone to move relative to the implant housing. This may at least partially isolate the microphone from non-ambient vibrations received by the implant housing while preserving the microphone's sensitivity to ambient sound vibrations. Furthermore, it will be appreciated that such a support membrane or membranes may be designed and/or tensioned to provide a desired compliancy (e.g., spring rate/damping coefficient). In the former regard, the thickness and the width of the membrane, as defined by the distance between where the membrane connects to the microphone and connects to the implant housing, may be adjusted to produce desired parameters. Accordingly, this allows for changing the natural frequency of the suspended system (e.g., support membrane(s) and microphone) as discussed above.

The support membrane may be made of any material that is operative to provide a compliancy of a desired magnitude. In this regard, the support membrane may be made of a metal or an elastomeric material. In the former case, a biocompatible metal (e.g., titanium, titanium alloys, gold, surgical stainless steels, etc.) may include surface features that allow the metallic membrane to have a desired compliancy (e.g., spring rate). For instance, a metal membrane may be corrugated to provide a bellows type arrangement. In one arrangement, the surface features may prevent loading of the membrane by overlying tissue. For instance, corrugations in the metal membrane may allow the membrane to deflect to a static position upon tissue loading. Once in such a static position, the compliancy of the metal may be utilized for vibration attenuation. Alternatively, the membrane may be made of an elastomeric material selected from, without limitation, one or more of the following: polybutadiene, polychloroprene, polyethylene, polyisobutylene, polyisoprene, polymethyl-methacrylate (PMMA), polyurethane or silicone elastomer.

In another application, the first compliant member may be defined by one or more sets of opposing magnets, wherein a first magnet is interconnected about the microphone and a second magnet is interconnected relative to the implant housing in opposing relation to the first magnet. In one arrangement, the first and second magnets may be disposed in a stacked arrangement with common poles in adjacent relation to each other. In another arrangement, the first and second magnets may be disposed in a side-by-side manner (e.g., concentric for ring magnets) with common poles in adjacent relation. Further, in either of the noted arrangements, the first and second magnets may be coincidentally shaped so that one of the magnets presents a recess and the other of the magnets is coincidentally shaped for at least partial positioning within such recess. As may be appreciated, the magnetic strength of the first and second magnets may be established to provide the desired compliancy (e.g., spring rate/damping coefficient).

In yet another application, the first compliant member may be defined by one or more compressible members (e.g., elastomeric members, springs, etc.) interposed between the microphone and a support surface of the implant housing (e.g., an interior surface of the implant housing). By way of example, such a compressible member may be a member that supports and/or receives a portion of a transducer of the microphone and whose base is interconnected to the implant housing.

In further applications, any or all of the above-noted compliant members may be utilized in various combinations to further isolate the microphone from non-ambient vibrations. For instance, the system may utilize both the compliant base member and the compliant ring-shaped membrane. Furthermore, it will be appreciated that when two or more compliant members are utilized those members may be utilized for different purposes. For instance, when a support membrane is utilized to compliantly support the microphone, magnets may be utilized for vibration damping purposes.

According to another aspect of the present invention, an implantable hearing instrument is provided that includes an implant housing for housing at least one hearing instrument component subcutaneously, a microphone operative to receive an ambient sound signal and output an audio signal, and at least a first compliant member for supporting at least one of the implant housing and the microphone. The hearing instrument further includes an actuator operative to receive the audio signal and stimulate a component of an implant wearer's auditory system in accordance with the output signal to generate a sensation of sound.

The actuator may be any one of a plurality of different types of actuators. For instance, in a middle ear hearing instrument, the actuator may be operative to mechanically stimulate (e.g., vibrate) one or more of the ossicles, which in turn causes stimulation of the cochlea through its natural input, the oval window. Such mechanical stimulation may be through direct coupling with the ossicular chain or via a magnetic connection. Alternatively, the actuator may generate an audio signal for use in stimulating the tympanic membrane which in turn stimulates the ossicular chain and thereby the cochlea. Further, the actuator may be operative to directly stimulate the cochlea.

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
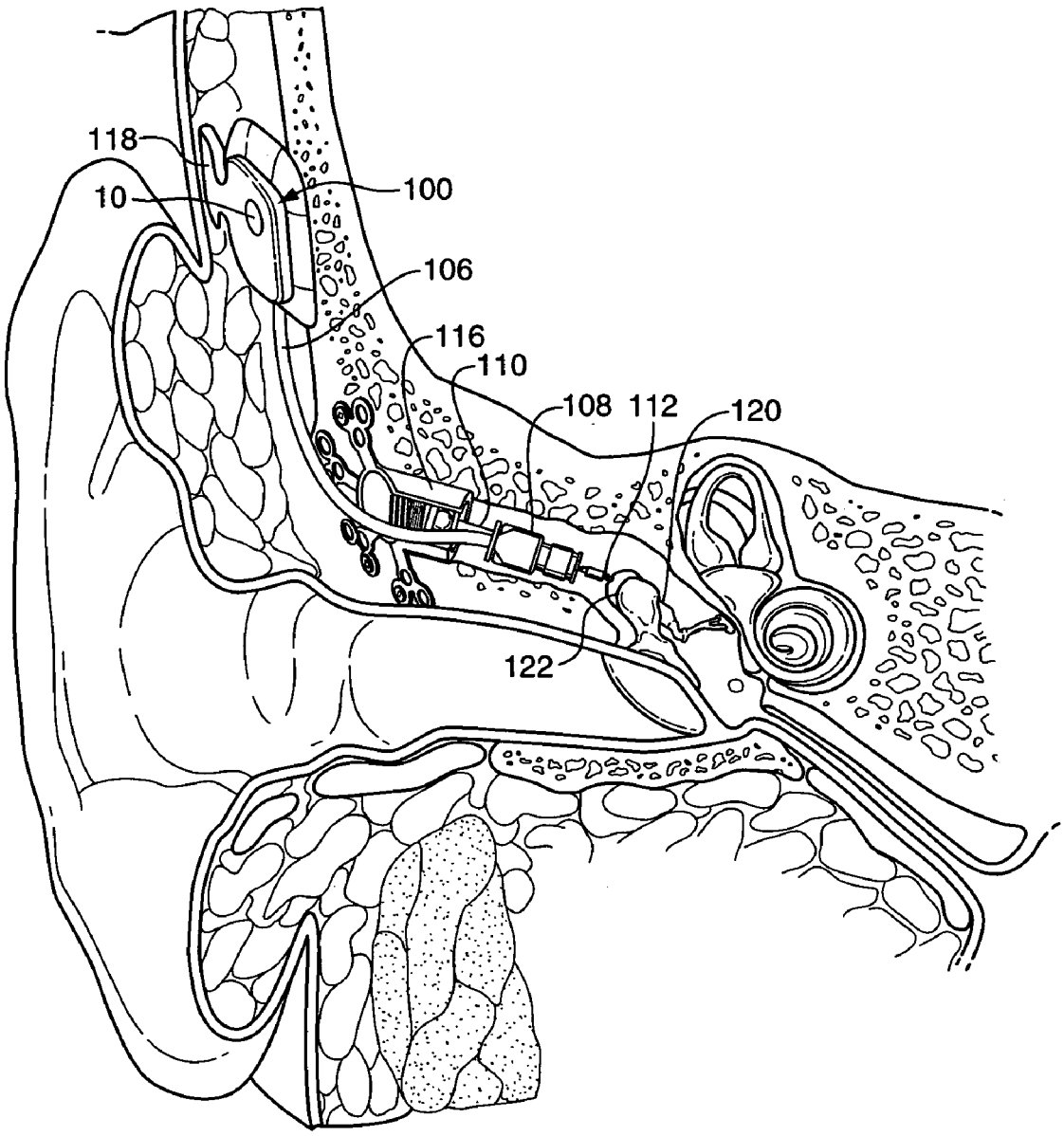
FIG. 1 illustrates a fully implantable hearing instrument as implanted in a wearer's skull.

Hearing Instrument System:

FIG. 1 illustrates one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, a biocompatible implant housing 100 is located subcutaneously on a patient's skull. The implant housing 100 includes a signal receiver 118 (e.g., comprising a coil element) and a microphone 10 that is positioned to receive acoustic signals through overlying tissue. The implant housing 100 may be utilized to house a number of components of the fully implantable hearing instrument. For instance, the implant housing 100 may house an energy storage device, a microphone transducer, and a signal processor. Various additional processing logic and/or circuitry components may also be included in the implant housing 100 as a matter of design choice. Typically, the signal processor within the implant housing 100 is electrically interconnected via wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

During normal operation, acoustic signals are received subcutaneously at the microphone 10. Upon receipt of the acoustic signals, a signal processor within the implant housing 100 processes the signals to provide a processed audio drive signal via wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

To power the fully implantable hearing instrument system of FIG. 1, an external charger (not shown) may be utilized to transcutaneously re-charge an energy storage device within the implant housing 100. In this regard, the external charger may be configured for disposition behind the ear of the implant wearer in alignment with the implant housing 100. The external charger and the implant housing 100 may each include one or more magnets to facilitate retentive juxtaposed positioning. Such an external charger may include a power source and a transmitter that is operative to transcutaneously transmit, for example, RF signals to the signal receiver 118. In this regard, the signal receiver 118 may also include, for example, rectifying circuitry to convert a received signal into an electrical signal for use in charging the energy storage device. In addition to being operative to recharge the on-board energy storage device, such an external charger may also provide program instructions to the processor of the fully implantable hearing instrument system.

Vibration Isolation:

FIGS. 2–11 show the use of different compliant members for use in reducing non-ambient/tissue-borne vibrations that may be received at the microphone 10. As discussed herein, the term tissue-borne and/or non-ambient vibrations is meant to represent those vibrations that do not originate as ambient sound. That is, non-ambient vibrations are those vibrations that may originate or propagate through a patient's tissue (e.g., bone or soft tissue) that are not caused by ambient sound impinging on tissue directly above the implanted microphone diaphragm 12. Stated otherwise, ambient sound vibrations cause desired vibrations that pass through tissue directly above the implanted microphone diaphragm 12.

Figure 2:
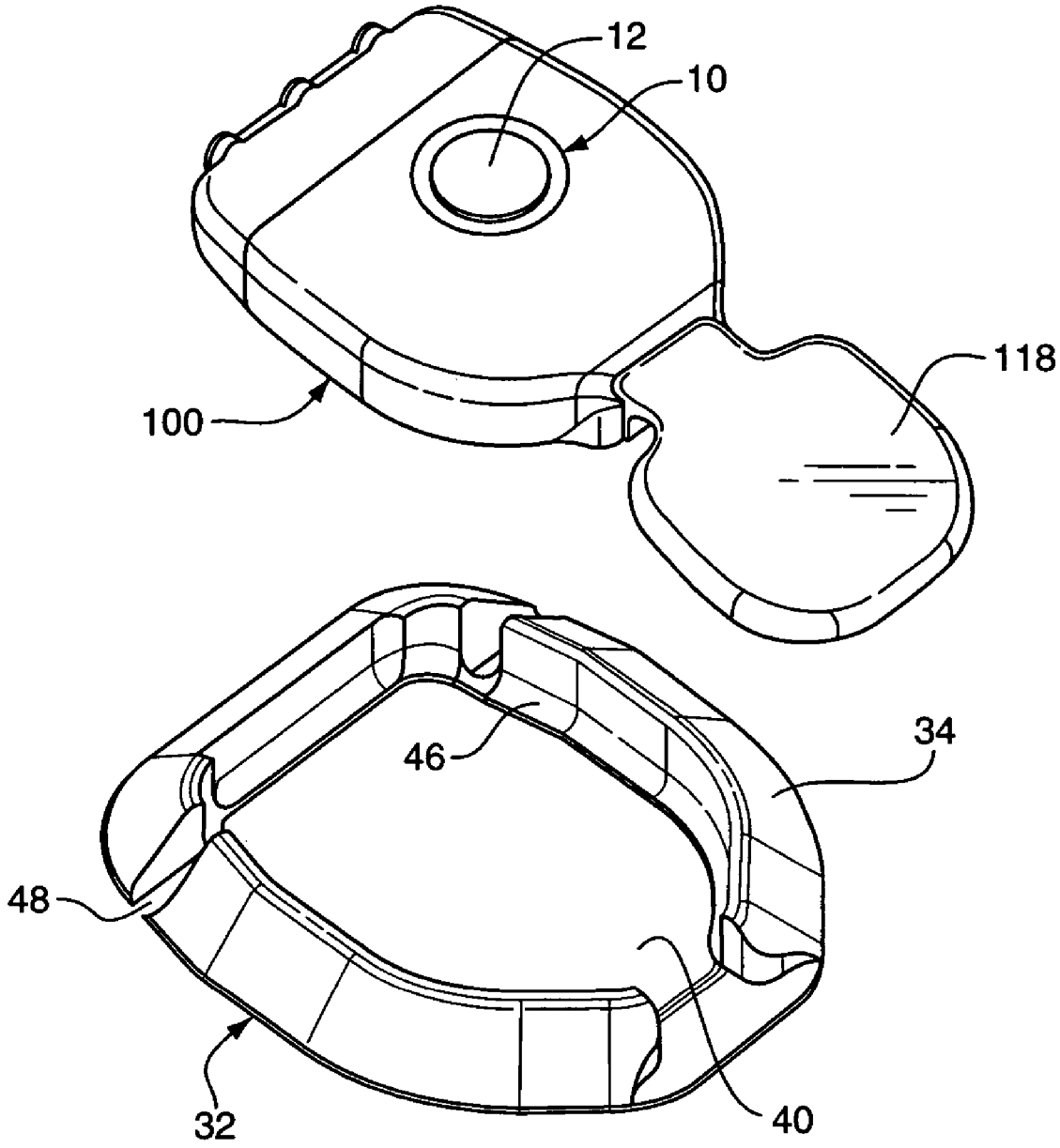
FIG. 2 shows an exploded perspective view of one embodiment of the present invention.
Figure 3:
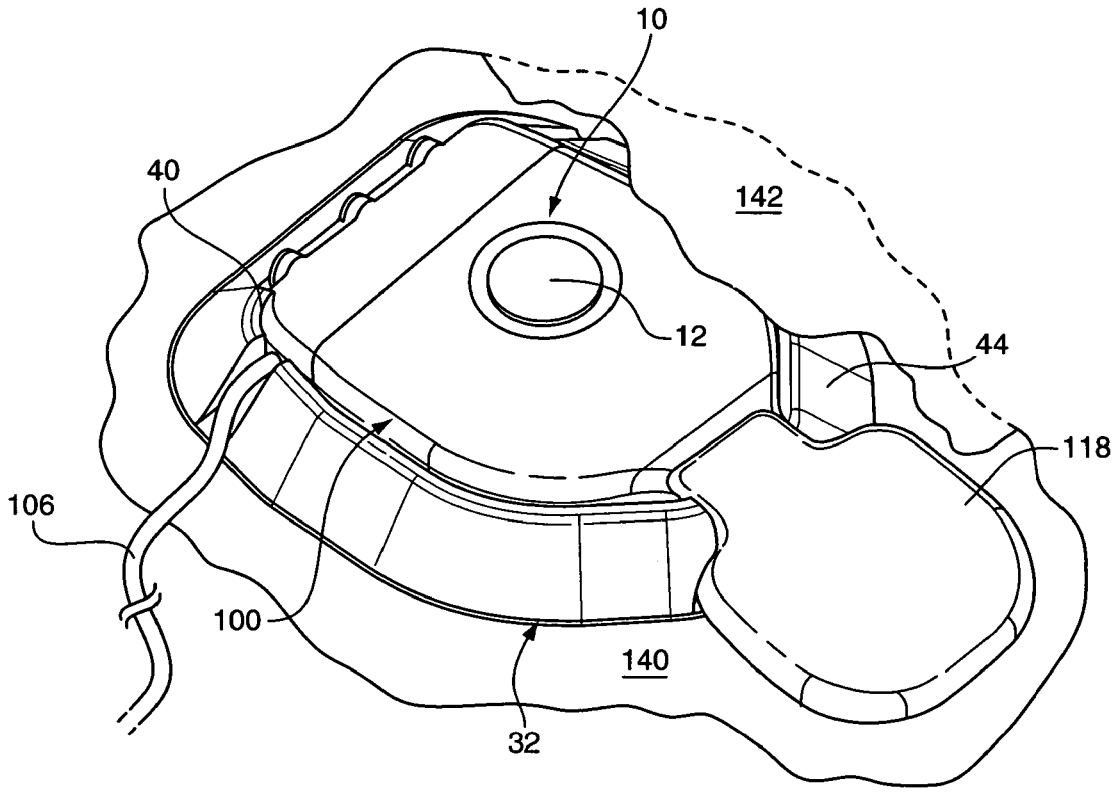
FIG. 3 is a perspective view of one embodiment of the present invention as implanted relative to a wearer's skull.

In a first embodiment as shown in FIGS. 2 and 3, a compliant base member 32 is utilized to reduce non-ambient vibrations that may be transmitted from an implant wearer's skull (i.e., skull-borne vibrations) and/or tissue to the implant housing 100 and, hence, the microphone diaphragm 12. The compliant base member 32 is designed to receive the implant housing 100 within a recess 40 (e.g., cup-shaped recess). The inside perimeter of the recess 40 contains a lip 46 that suspends the bottom of the implant housing 100 above the patient's skull upon being implanted. In this regard, the compliant base member 32 forms a barrier between a source of non-ambient vibration and the microphone diaphragm 12. The base member 32 and the implant housing 100 also form a suspended system. The physical characteristics of the compliant base member 32 may be selected in order to alter the natural frequency of the suspended system. This may allow for preferentially attenuating unwanted/non-ambient vibration. For best vibration isolation, it is desirable that the suspended system (i.e., compliant base member 32 and housing 100) have a natural, or resonant, frequency substantially lower than the lowest frequency to be attenuated. For example, if the natural frequency of the suspended system is ⅕ that of the lowest frequency to be attenuated, transmission of that frequency will be reduced to $1/24^{th}$ its original value. In the embodiment shown, this goal is achieved by selecting an appropriate combination of suspended mass, suspension compliance, and (optionally) suspension damping coefficient.

The compliant base member 32 is designed to hold the implant housing 100 such that the microphone diaphragm 12 is positioned to receive ambient acoustic signals through overlying tissue. Further, the compliant base member 32 includes a channel 48 through the periphery 44 of the recess 40 that allows wire 106 to be routed from the implant housing 100 to the transducer free of obstruction.

In FIG. 3 the compliant base member 32 is shown as it would appear in use in relation to a patient's skull 140, and skin 142 (e.g., each shown in cut-away relation). In this regard, the implant housing 100 is disposed within the recess 40 in the compliant base member 32. The base of the compliant base member 32 is shown in conformal, or flush, contact in relation with the patient's skull 140. Note that the periphery 44 of the base isolator 32 is tapered such that it merges with the outer surface of the implant housing 100. This provides a continuous, uniform support for the patient's overlying skin 142, thereby reducing discomfort for the user, preventing localized concentrations of pressure and reducing the potential for impaired circulation and consequent tissue damage.

As will be appreciated, the compliancy of the compliant base member 32 allows for damping non-ambient vibrations prior to those vibrations reaching the implant housing 100. To achieve such compliancy, the compliant base member 32 may be formed of an elastomeric material. Elastomeric materials that may be utilized to form the compliant base member 32 include, without limitation, one or more of the following: silicone elastomer, polybutadiene, polychloroprene, polyethylene, polyisobutylene, polyisoprene, polymethyl-methacrylate (PMMA), polyurethane or silicone elastomer. Additionally, one or more elastomeric materials may be blended with one another or other materials to achieve a desired compliancy. Further, it will be noted that elastomeric materials may allow for forming the compliant base member 32 in an injection molding process and/or as a single-piece unit.

In one arrangement, voids (e.g., gas bubbles or hollow beads) may be introduced into an elastomeric material or a non-elastomeric material to enhance the material's compliancy and/or increase the ability of the material to attenuate vibration. In this regard, the use of voids within the base member 32 allows for attenuation and/or reflectance of vibration energy as that energy passes through each void/base member interface. In another arrangement, which may be used in conjunction with voids in the base member 32, metallic flakes (e.g., titanium flakes) are incorporated into the base member 32. These flakes provide the opportunity for multiple reflections that operate to disperse vibration energy.

Figure 4:
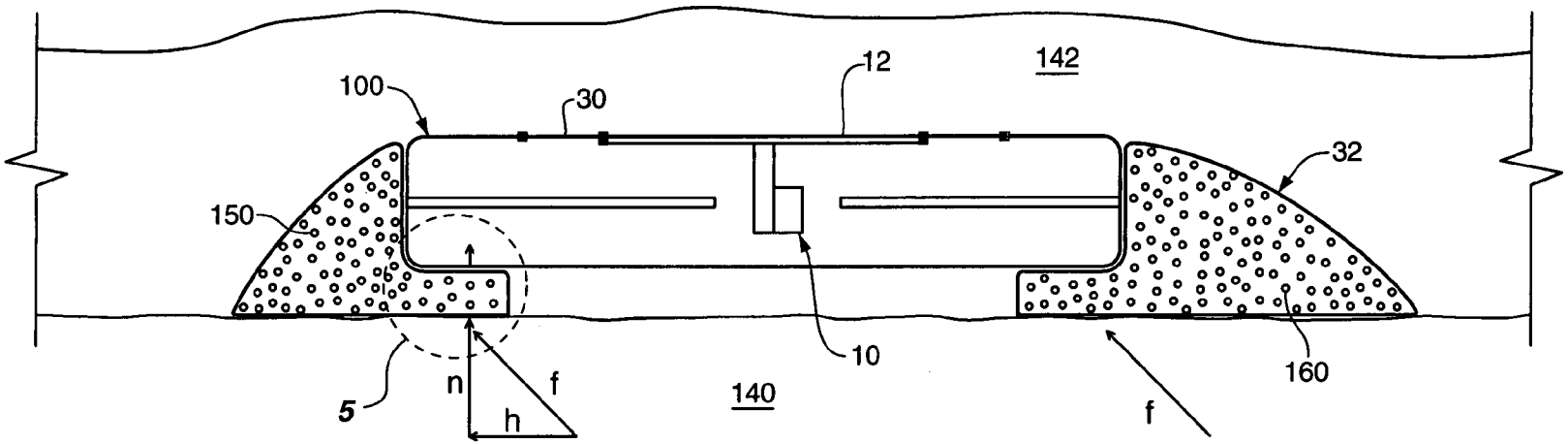
FIG. 4 shows a cross-sectional view of one embodiment of the present invention as implanted relative to a wearer's skull.

FIG. 4 shows a cross-sectional view of implant housing 100 as seated within the compliant base member 32 and mounted on the patient's skull 140. As shown, the compliant base member 32 incorporates a plurality of voids 150 within its structure. Though discussed herein as utilizing voids 150, it will be appreciated that solid materials (e.g., titanium flakes) disposed within the matrix of the compliant base member 32 may have substantially similar reflective/attenuative properties.

Figure 5:
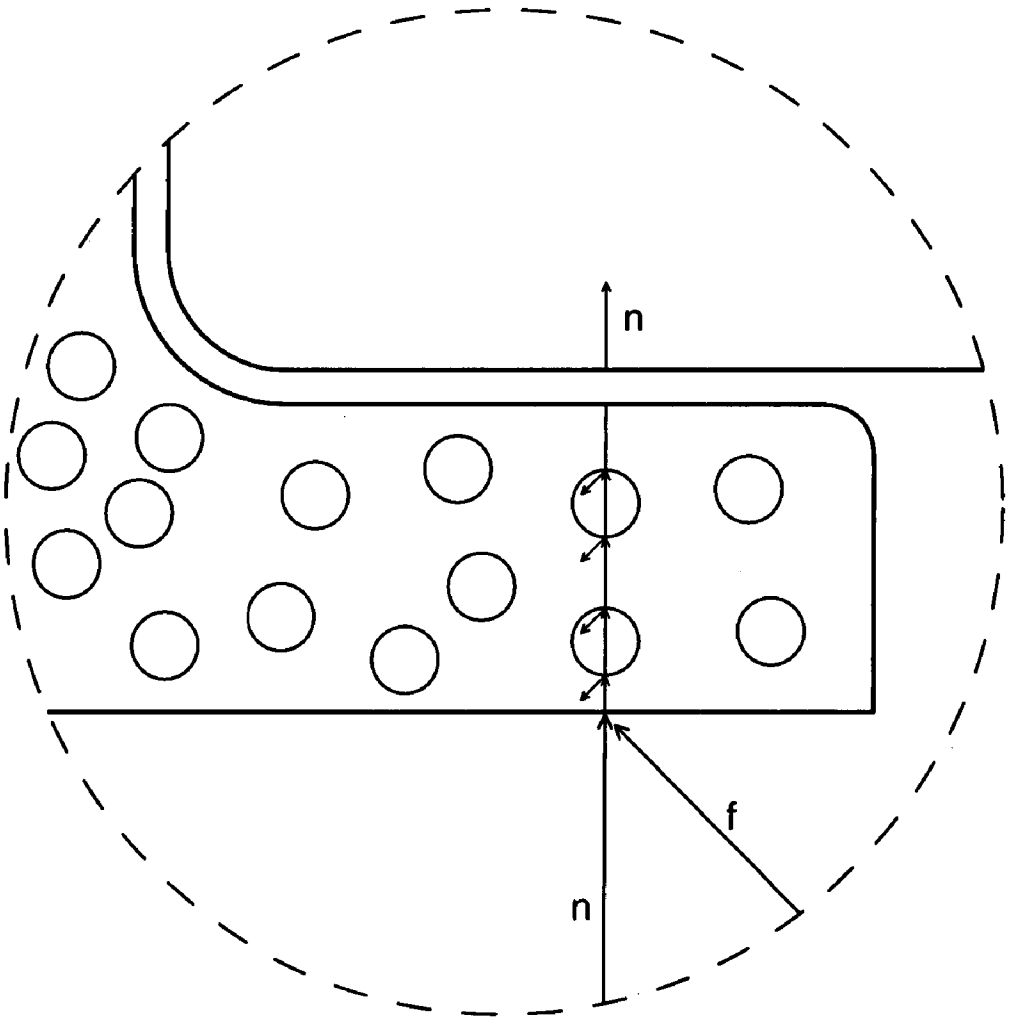
FIG. 5 shows an exploded portion of FIG. 4.

As shown, the base member 32 and implant housing 100 are subjected to vibrational forces as represented by the forces as labeled $f$ in FIG. 4. As shown in FIG. 5, these forces $f$ each have a normal component n (i.e., that is perpendicular to the microphone diagram 12) and a horizontal component h. For purposes of reducing tissue-borne vibration seen by the microphone diaphragm 12, the normal component n is of foremost interest as this component accounts for a majority of the relative movement between the microphone diaphragm 12 and tissue overlying the microphone diaphragm 12. In this regard, the relative movement creates undesired vibrations in the diaphragm 12. As shown in FIG. 5, the normal component n of the vibration force $f$ passes into the compliant base member 32. Initially, at the interface between the client base member 32 and the patient's skull, a portion of the normal component is reflected. Likewise, a portion of the normal component is reflected at each base member/void interface as the normal component passes through the base member 32. As will be appreciated, the reflected portion of the normal component may attenuate/cancel subsequent forces. Once the normal component passes into the microphone housing 100, the amplitude of the normal component is considerably attenuated.

As shown in FIG. 4, this attenuated normal component may pass through the substantially rigid surface of the compliant housing 100 until it is projected normal to the surface of the implant housing 100. As noted above, this force may cause tissue movement above the implant housing 100 and thereby cause relative movement between the diaphragm 12 and the overlying tissue. However, a support membrane may be utilized to further reduce the relative movement between the overlying tissue and the microphone diagram 12, as will be discussed herein.

Figure 6:
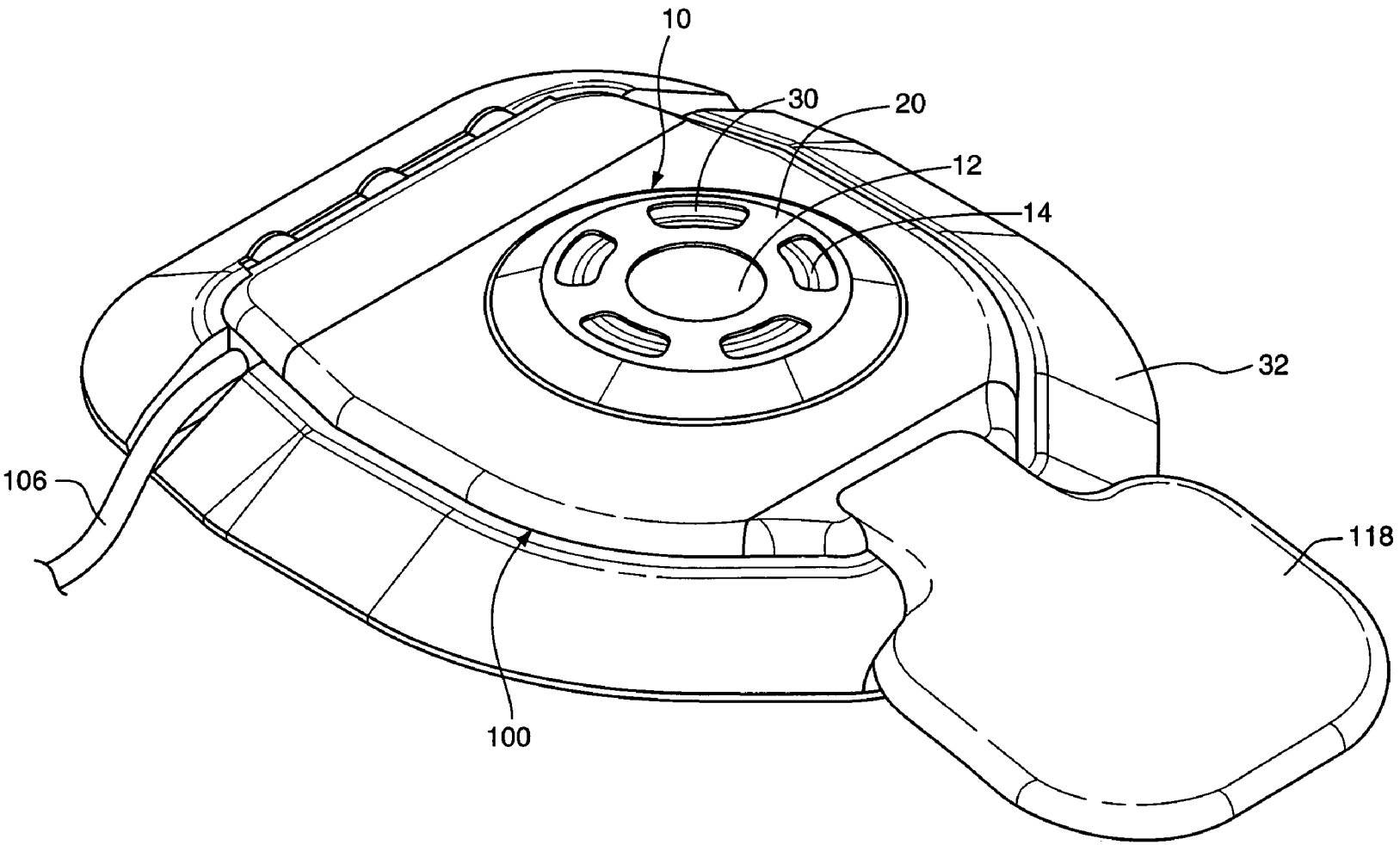
FIG. 6 shows another embodiment of the present invention.
Figure 7:
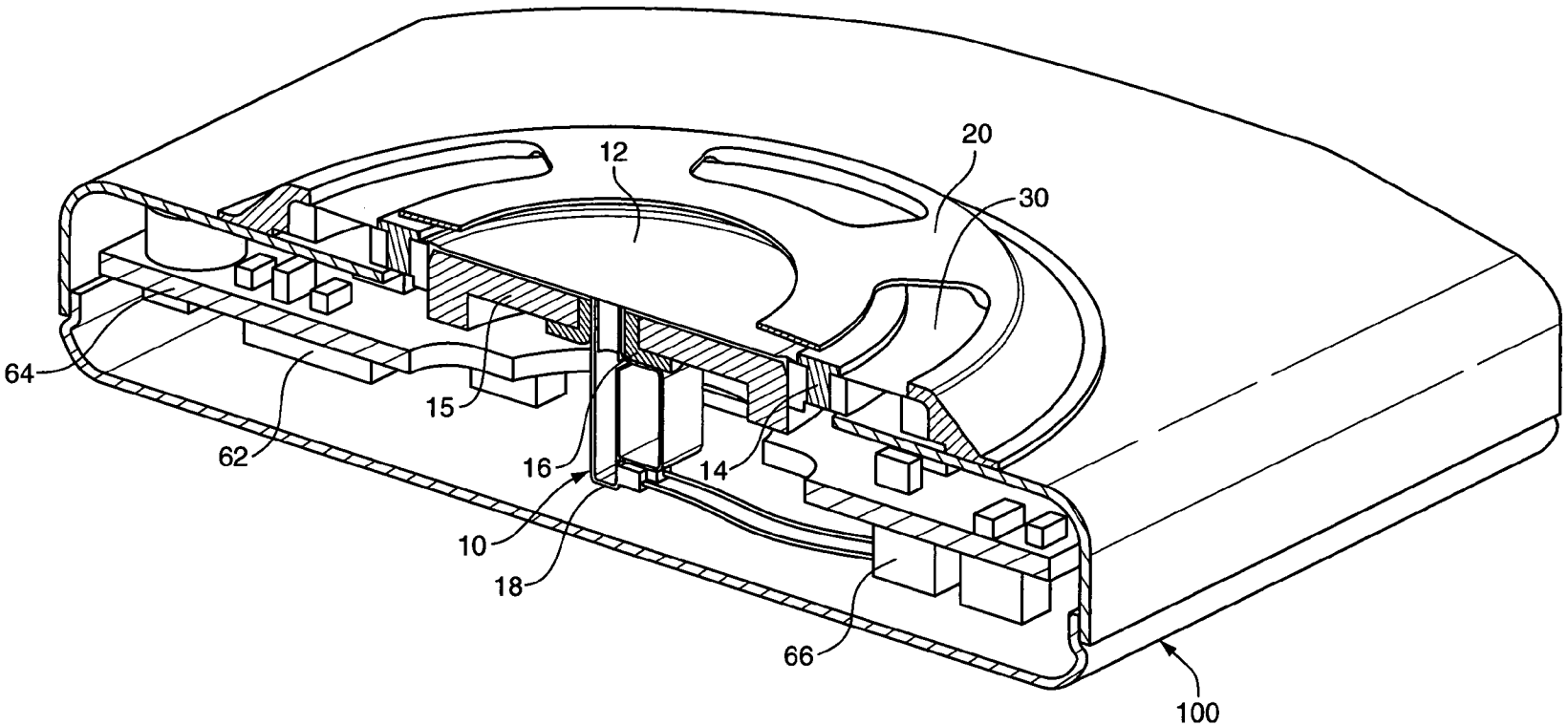
FIG. 7 shows a perspective cross-sectional view of the embodiment of FIG. 6.

FIGS. 6 and 7 show another embodiment of a compliant member that may be utilized for reducing non-ambient vibrations received by the microphone diaphragm 12. In this embodiment, a support membrane 30 is utilized to compliantly suspend a microphone 10 relative to the implant housing 100. In this regard, the membrane 30 operates to absorb non-ambient energy while holding the microphone diaphragm 12 still relative to overlying tissue. In the embodiment shown, the support membrane 30 is interconnected to the periphery of the microphone 10. More particularly, an inner portion of the support membrane is interconnected about the perimeter of the microphone 10 while an outer portion is interconnected to the implant housing 100. In this embodiment, the support membrane 30 may be termed a ring-membrane. However, it will be appreciated that the support membrane 30 need not be continuous about the periphery of the microphone housing, nor define a ring. Further, it will be noted that while the support membrane is illustrated in a substantially common plane with the microphone diaphragm 12 this need not be the case.

The suspended microphone 10 includes an external microphone diaphragm 12 (e.g., a titanium membrane) and a microphone housing having a surrounding support member 14 a base member 15 and a central member 16. When assembled, these members 14–16 support the microphone diaphragm 12 relative to an acoustic chamber defined by the base member 15, central member 16 and diaphragm 12. As shown in FIGS. 6 and 7, an optional protective grill 20 is interconnected about its periphery to the implant housing 100 and extends over the microphone diaphragm 12 and the support membrane 30. The microphone 10 also includes an internal microphone transducer 18 (e.g., an electroacoustic transducer such as an electret microphone). The microphone transducer 18 provides an electrical output responsive to vibrations of the diaphragm 12 caused by acoustic signals impinging thereupon. This output is provided via one or more wires to a processor 66. The processor 66 and/or circuit components, and an on-board energy storage device 62 may be supportably mounted to a circuit board 64 that is fixed interconnected within the implant housing 100.

The support membrane 30 allows for relative movement between the microphone 10 and the implant housing 100 thereby at least partially isolating the microphone 10 from vibrations received by the implant housing 100. In this regard, the microphone 10 is mounted within an opening of implant housing 100 by the support membrane 30, which, in the present embodiment, is sealably interconnected to and between the microphone and implant housing 100. Again, the microphone diaphragm 12, transducer 18, microphone housing (i.e., members 14, 15 and 16) and support membrane 30 form a suspended system, wherein the support membrane 30 functions as a compliant suspension. As shown in FIG. 6, the compliant base isolator 32 (e.g., an elastomeric member) may also be utilized in conjunction with the support membrane 30.

Because the support membrane 30 allows the implant housing 100 to move relative to the microphone 10 in response to vibration, the motion of the microphone relative to the overlying tissue is reduced. As relative motion is reduced, the pressures applied to the microphone diaphragm 12 caused by the vibrations are also reduced, making the diaphragm 12 less sensitive to that vibration. For best isolation, it is desirable that the suspended system (i.e., microphone and ring-shaped membrane 30) have a natural, or resonant, frequency substantially lower than the lowest frequency to be attenuated. For example, if the natural frequency of the suspended system is ⅕ that of the lowest frequency to be attenuated, transmission of that frequency will be reduced to $1/24^{th}$ its original value. In the embodiment shown, this goal is achieved by selecting an appropriate combination of suspended mass, suspension compliance, and (optionally) suspension damping coefficient.

In use, the implant housing 100 moves relative to the microphone diaphragm 12 under the influence of vibration transmitted through the implant housing 100 (i.e., non-ambient vibration). Again, this relative motion reduces the pressure produced on the microphone diaphragm 12 by that vibration, and thus its sensitivity to it. Vibration produced by ambient sound impinging on the skin above the microphone diaphragm 12 are not attenuated in the same way or to the same degree as vibration transmitted through the implant housing 100. For this reason, the suspended assembly has a desirably superior sensitivity to ambient sound as compared to non-ambient/tissue borne vibrations.

The properties of the suspended system are chosen to optimize its desirable properties of sensitivity to ambient sound vibration and relative insensitivity to non-ambient/tissue transmitted vibration. These include the mass of the suspended microphone including the microphone diaphragm 12, transducer 18 and microphone housing (i.e., members 14, 15 and 16), as well as the material, membrane thickness, tension, and the width of a cross-dimension (e.g., between an inside diameter and an outside diameter) of the support membrane 30 (all influencing its spring rate), the tension of the microphone diaphragm 12 (or lack of tension) and the spring rate/damping coefficient of any optional/additional compliant member(s) such as the compliant base member 32.

Figure 8A:
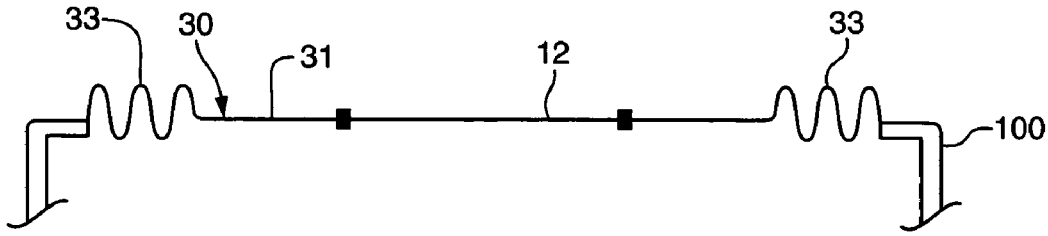
FIGS. 8*a* and 8*b* show a cross-sectional view of one embodiment of a support membrane.
Figure 8B:
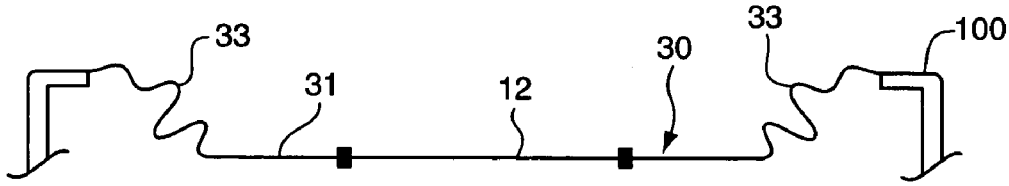

In one particular embodiment, where the support membrane 30 comprises a titanium membrane, the titanium membrane 30 may further incorporate one or more corrugations to account for tissue loading. As shown in FIGS. 8*a* and 8*b*, the corrugated titanium membrane 30 suspends the microphone diagram 12 relative to an implant housing 100. A compliant portion 31 of the titanium membrane 30, operative to attenuate tissue-borne/non-ambient vibrations, extends between the corrugations 33 and a connector ring member 14, which is disposed between the diaphragm 12 and the membrane 30. As will be appreciated, titanium has a narrow range of compliancy and pressure of overlying tissue on such a titanium membrane 30 may over-tension the compliant portion 31 of the titanium membrane 30. Such over-tensioning of the compliant portion 31 may limit the membrane's ability to attenuate undesired vibrations. To alleviate over-tensioning of the compliant portion 31, one or more corrugations 33 are provided to allow the titanium membrane 30 to deflect upon tissue loading. See FIG. 8*b*. This deflection may prevent over-tensioning within the compliant portion 31 of the titanium membrane 30. Accordingly, the titanium membrane 30 may maintain a very low resonant frequency (e.g., ideally zero).

Figure 9:
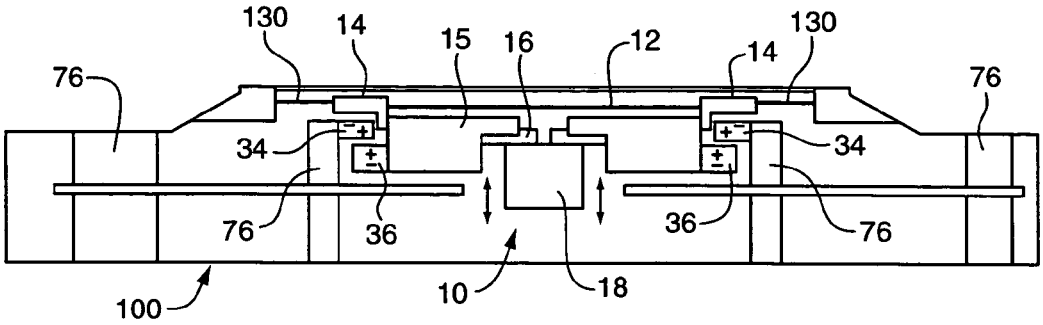
FIGS. 9–11 show cross-sectional views of alternate embodiments of the present invention.
Figure 10:
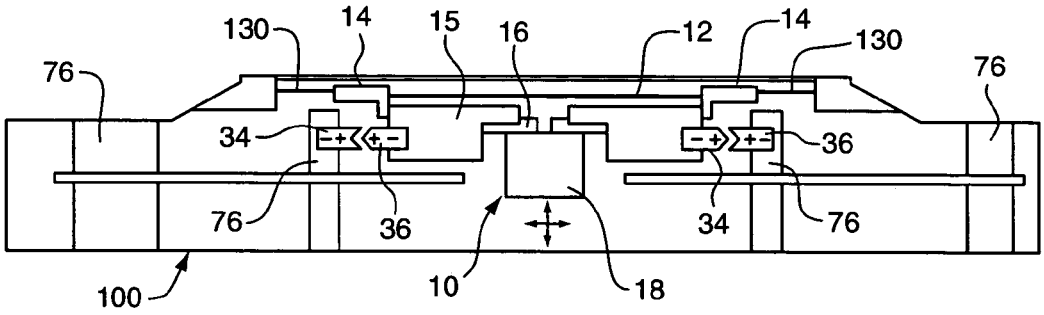
Figure 11:
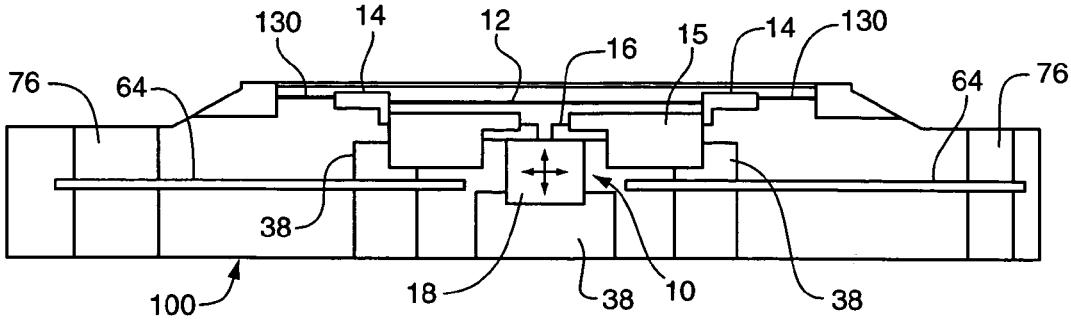

FIGS. 9, 10 and 11 illustrate alternate compliant members and/or damping members. The illustrated embodiments are otherwise like the embodiment of FIGS. 2–5 and therefore FIGS. 9–11 use like reference numerals.

With reference to FIGS. 9 and 10, a first ring magnet 36 is interconnected about the base member 15 of the microphone housing. In turn, a second ring magnet 34 is interconnected to a support member 76 interconnected to circuit board 64 and/or directly to an inside surface of implant housing 100. As shown, the first and second ring magnets 36 and 34 are positioned in opposing relation with common poles in an adjacent relation. In FIG. 9, the first and second ring magnets 36, 34 are disposed in a stacked fashion. In FIG. 10, the first and second ring magnets 36, 34 are disposed in a concentric fashion. With particular reference to FIG. 10, the first and second ring magnets may be shaped with opposing v-shaped peripheries for partial mating interface. As may be appreciated, the first and second ring magnets 36, 34 in FIGS. 9 and 10 may be magnetized to add a desired spring rate and/or damping coefficient within the overall suspended system.

Referring now to FIG. 11, one or more compliant block members 38 are illustrated. As shown, such compliant block members 38 may be interposed in contact relation between microphone transducer 18 and implant housing 100 and/or circuit board 64 connected thereto. Again, the compliant block members 38 may be provided to contribute a desired degree of damping and/or spring rate to the suspended system.

In each of the embodiments shown in FIGS. 9, 10 and 11, an isolator membrane 130 is sealably interconnected between the microphone 10 and implant housing 100. Though similar to the support membrane 30 discussed above, the isolator membrane 130 does not necessarily support the microphone 10. A virtue of the inclusion of the optional compliant member(s) 38 and or magnets 34, 36 described with respect to each of the embodiments, the compliancy of the isolator membrane 130 may be increased (e.g., in comparison with the support membrane 30) to yield an overall system having enhanced isolation of non-ambient vibration. In this regard, one function of the isolator membrane 130 is to seal the housing 100 from, for example, bodily fluids.

As noted above, the mass of the microphone 10 and the support membrane 30, as well as the spring rate and damping coefficient determined by the thickness, geometry, tension and material stiffness of the support membrane 30, combinatively define a supported system having a natural, or resonant, frequency. Likewise, when the base isolator 32 is utilized, the implant housing 100 (which may include the ring-shaped membrane 30) and base isolator 32 will also define a supported system having a natural or resonant frequency. In any case, it is desirable that the natural frequency of the supported system be lower than the frequency of vibration to be isolated from, or attenuated.

In one example, where compliant base isolator 32 is utilized without the support membrane 30, a resonant frequency one-fifth of the frequency to be attenuated results in attenuation of 24:1. In this regard, the relative transmissibility of vibration is given by:

$$\mu = \sqrt{\frac{1 + \left(2\zeta\frac{\omega}{\omega_n}\right)^2}{\left(1 - \frac{\omega^2}{\omega_n^2}\right)^2 + \left(2\zeta\frac{\omega}{\omega_n}\right)^2}} \tag{1}$$

Where:

$\mu$ is the absolute force transmissibility coefficient;

$\omega$ is the angular frequency to be isolated;

$\omega_n$ is the natural angular frequency of the system; and $\zeta$ is the relative damping coefficient This expression may be utilized to predict the performance of the example system. For this example, assume that:

$\omega$ is the angular frequency to be isolated;

$\omega_n$ is the natural angular frequency of the system. For a suspended mass of 23 grams and a spring rate of 214 gmf/mm, this is calculated to be approximately 302 rad/sec, or 48 Hz.

$\zeta$ is the relative damping coefficient

Figure 12:
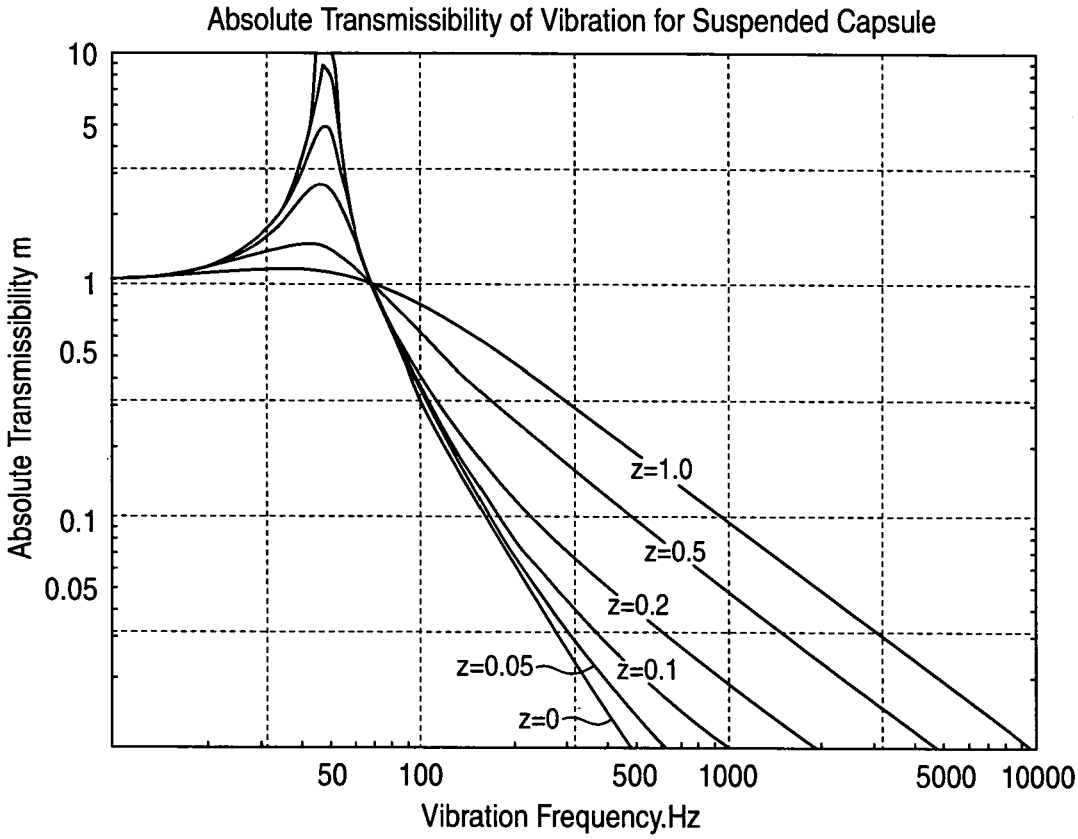
FIG. 12 shows a plot of vibration transmissibility versus damping coefficients.

The plot of FIG. 12 shows the transmissibility coefficient to be expected from this supported system for a variety of damping coefficients.

To illustrate the effectiveness of the invention, consider the attenuation that might be achieved at 1000 Hz. As may be seen from the plot, a critically damped isolator 30 ($\zeta$=1.0) would be expected to produce an absolute transmissibility of 0.1, i.e., the vibration transmitted to the implant housing 100 and hence the microphone diaphragm 12 will be attenuated in this case to 10% of its original intensity. Similar calculations may be performed for the support membrane 30 and microphone supported system as well as for supported systems that utilize additional compliant members (e.g., compliant block 38).

As will be appreciated, changes may be made to the base isolator 32 to alter one or more supported system characteristics. For example, introducing bubbles of gas into an elastomer utilized to form the compliant base isolator 32 may change its compliance, or the viscoelastic properties of certain elastomers may be advantageously utilized to achieve vibration isolation shaped by frequency. Additionally, various combinations of the base isolator 32, support membrane 30, magnets 34, 36, and compliant block members 38 may be utilized to selectively tailor the resonant frequency of the supported system.

Figure 13:
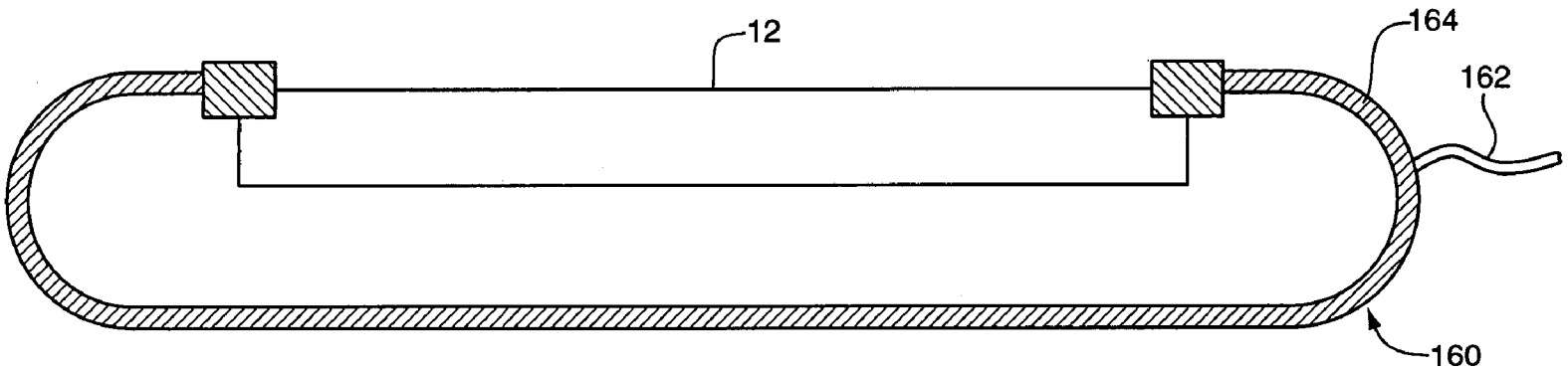
FIGS. 13, 14 and 15 show alternate embodiments of separate microphone assemblies that may be utilized with the present invention.
Figure 14:
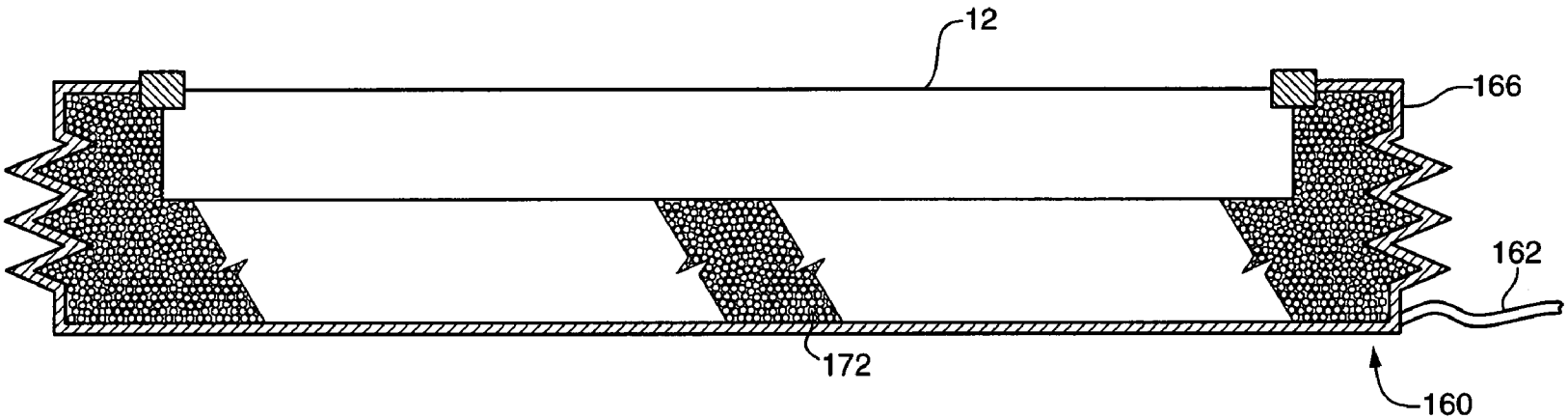
Figure 15:
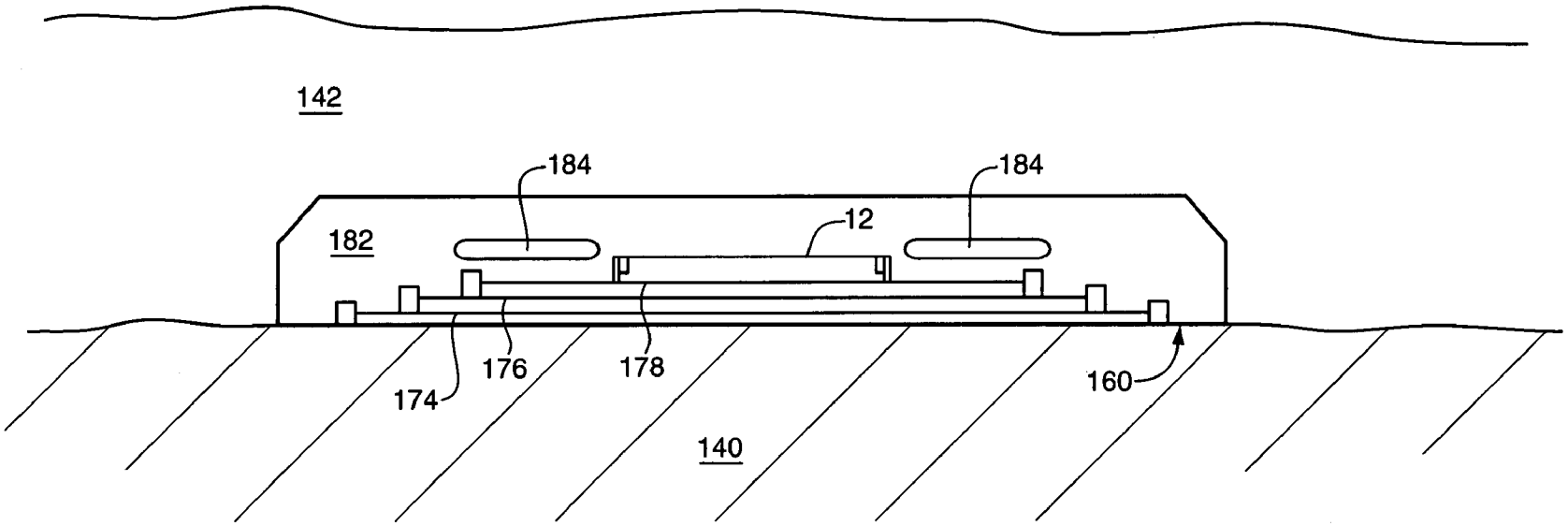

It will be further appreciated that other embodiments for use in attenuating non-sound vibrations may be utilized. For instance, FIGS. 13–15 show embodiments, wherein a separate microphone 160 is utilized. That is, a separate microphone 160 may be interconnected to the implant housing via one or more wires 162. In this instance, the microphone 160 may include a flexible housing 164 that is operative to attenuate non-ambient/tissue-borne vibration. For instance, as shown in FIG. 13, the housing 164 is formed of a foil structure that is operative to act as a spring. In this embodiment, the non-rigid foil housing 164 is able to flex in order to absorb tissue-borne vibrations.

In another embodiment shown in FIG. 14, a rigid housing 166 is utilized that incorporates a shock absorbing system. In particular, the rigid housing 166 includes an accordion perimeter 168 about the periphery of the housing that allows for absorbing the normal component of non-ambient/tissue-borne vibrations received by the housing 166. Furthermore, a void within the housing 160 (e.g., the area beneath the microphone diagram 12) may be filled with vibration absorbing material(s). For instance, such an area may be filled with hollow glass beads 172 that allow for reflectance and/or absorbance of received vibrations.

In a yet further embodiment shown in FIG. 15, a separate microphone 160 is provided that includes a diaphragm 12 that is supported relative to patient's skull 140 by three stacked membranes 174, 176 and 178 (e.g., titanium membranes). The membranes 174–178 as well as the diaphragm 12 are at least partially encapsulated in a flexible substrate 182. However, the membranes 174–178 are each separated by an air gap for vibration attenuation purposes. Accordingly, as a normal component of a tissue originating vibration passes between the membranes 174–178, those vibrations will be attenuated and/or reflected. Finally, the flexible substrate 182 further incorporates a void 184 that extends about the perimeter of the diaphragm 12 for further attenuation of vibrations received by the microphone 160. In this regard, the void 184 is operative to attenuate tissue-borne vibrations that originate from the skull 140 as well as ambient sound vibrations that are not directly incident on the diaphragm 12. In one embodiment, the void 184 is formed from a sealed titanium envelope. However, it will be appreciated that other materials may be utilized to form the void 184.

Those skilled in the art will appreciate variations of the above-described embodiments that fall within the scope of the invention. As a result, the invention is not limited to the specific examples and illustrations discussed above, but only by the following claims and their equivalents.

What is claimed:

1. A system for isolating an implantable hearing aid microphone from non-ambient vibrations, comprising:

an implant housing for housing at least one hearing aid component subcutaneously;

a microphone supported relative to said housing, said microphone including;

a diaphragm, a transducer; and a microphone housing for holding said transducer relative to said diaphragm; and a first compliant member for compliantly supporting at least one of said housing and said microphone, wherein said first compliant member is disposed between said at least one of the housing and the microphone and a source of non-ambient vibration.

2. The system of claim 1, wherein said first compliant member and said at least one of said housing and said microphone supported by said first isolation member in combination define a supported system having a natural frequency of less than about 2000 Hz.

3. The system of claim 2, wherein said supported system has a natural frequency of less than about 200 Hz.

4. The system of claim 3, wherein said supported system has a damping coefficient between 0 and 1.

5. The system of claim 1, wherein said first compliant member is disposed between said microphone and said housing such that said first compliant member compliantly supports said microphone.

6. The system of claim 5, wherein said first compliant member comprises a membrane.

7. The system of claim 6, wherein said membrane comprises a plurality of separate membrane sections.

8. The system of claim 7, wherein said plurality of separate membrane sections are spaced about a periphery of said microphone.

9. The system of claim 8, wherein said plurality of separate membrane sections are equally spaced about said periphery.

10. The system of claim 6, wherein said membrane is disposed about at least a portion of said microphone.

11. The system of claim 10, wherein said membrane is disposed entirely about a periphery of said microphone.

12. The system of claim 10, wherein said membrane has an inside perimeter interconnected to said microphone and an outside perimeter interconnected to said housing.

13. The system of claim 12, wherein said membrane is in tension between said inside perimeter and said outside perimeter.

14. The system of claim 12, wherein said membrane is in a substantially non-loaded condition between said inside perimeter and said outside perimeter.

15. The system of claim 6, further comprising:

a first magnet interconnected to said microphone; and a second magnet interconnected to said housing, wherein said first and second magnets have like poles disposed in an adjacent non-touching relationship and provide damping for said microphone supported by said ring-shaped member.

16. The system of claim 5, further comprising:

at least a second compliant member adapted to support a compressive force between structure associated with said microphone and structure associated with said housing.

17. The system of claim 5, further comprising:

a second compliant member disposed on an outside surface of said housing.

18. The system of claim 1, wherein said first compliant member is disposed on an outside surface of said housing.

19. The system of claim 18, wherein said compliant member includes a plurality of voids within its structure.

20. The system of claim 19, wherein said plurality of voids are formed from at least one of:

gaseous bubbles; and hollow beads.

21. The system of claim 18, wherein said first compliant member further comprises:

a recess sized to matingly receive at least a portion of said housing.

22. The system of claim 21, wherein said first compliant member forms a substantially cup-shaped compliant member.

23. The system of claim 22, wherein an outside peripheral edge of said substantially cup-shaped compliant member is tapered to substantially merge with an outer surface of said housing when said housing is disposed in said recess.

24. The system of claim 18, further comprising:

a second compliant member disposed between said microphone and said housing such that said second compliant member compliantly supports said microphone.

25. The system of claim 18, further comprising:

a second compliant member adapted to compliantly support a compressive force between structure associated with said microphone and structure associated with said housing.

26. The system of claim 1, wherein said first compliant member comprises:

a first magnet interconnected to said microphone; and a second magnet interconnected to said housing, wherein said first and second magnets have like poles disposed in an adjacent non-touching relationship.

27. The system of claim 1, wherein said first compliant member comprises a member adapted to compliantly support a compressive force between structure associated with said microphone and structure associated with said housing.

28. A system for isolating an implantable hearing aid microphone from non-ambient vibrations, comprising:

an implant housing for housing at least one hearing aid component subcutaneously;

a microphone supported relative to said housing; and a compliant base member disposed on an outside surface of said housing, wherein said compliant base member is disposed between said housing and a source of non-ambient vibration and wherein said compliant base member comprises an elastomeric material.

29. The system of claim 28, wherein said compliant base member includes a plurality of voids within its structure.

30. The system of claim 29, wherein said plurality of voids are formed from at least one of:

gaseous bubbles; and hollow beads.

31. The system of claim 28, wherein said compliant base member has a Shore A durometer hardness of not more than about 60.

32. The system of claim 28, wherein said elastomeric material comprises at least one of:

a polybutadiene a polychloroprene a polyethylene a polyisobutylene a polyisoprene a polymethyl-methacrylate (PMMA)

a polyurethane a silicone elastomer.

33. The system of 28, wherein said compliant base member is of a single-piece construction.

34. The system of 28, wherein said compliant base member is a molded elastomeric material.

35. The system of claim 28, wherein said compliant base member further comprises:

a recess shaped to matingly receive at least a portion of said housing.

36. The system of claim 35, wherein said compliant base member is substantially cup-shaped.

37. The system of claim 36, wherein an outside peripheral edge of said substantially cup-shaped compliant base member is tapered to substantially merge with an outer surface of said housing when said housing is disposed in said recess.

38. A system for isolating an implantable hearing aid microphone from non-ambient vibrations, comprising:

an implant housing having an internal chamber with an opening thereto;

a microphone; and a compliant membrane for suspending said microphone relative to said opening.

39. The system of claim 38, wherein said microphone comprises:

a diaphragm, a transducer; and a microphone housing for holding said transducer relative to said diaphragm.

40. The system of claim 38, wherein said compliant membrane comprises a plurality of separate membrane sections.

41. The system of claim 40, wherein said separate membrane sections are spaced about a periphery of said microphone.

42. The system of claim 41, wherein said separate membrane sections are equally spaced about said periphery of said microphone.

43. The system of claim 38, wherein said compliant membrane comprises a ring-shaped membrane.

44. The system of claim 43, wherein said ring-shaped membrane is sealably disposed around a portion of said microphone and supports said microphone relative to said opening, wherein said microphone and said ring-shaped membrane seal said internal chamber.

45. The system of claim 38, wherein said compliant membrane comprises a biocompatible metallic membrane.

46. The system of claim 45, wherein said metallic membrane further includes at least one corrugation.

47. The system of claim 45, wherein said metallic membrane defines a bellows.

48. The system of claim 45, wherein said biocompatible metallic membrane is formed at least in part of titanium.

49. The system of claim 38, wherein said compliant membrane comprises an elastomeric material.

50. The system of claim 49, wherein said elastomeric material comprises at least one of:

a silicone elastomer; and a polyurethane.

51. The system of claim 38, further comprising:

a first magnet interconnected to with structure associated with said microphone; and a second magnet interconnected with structure associated with said housing, wherein said first and second magnets have like poles disposed in an adjacent non-touching relationship.

52. The system of claim 51, wherein said first and second magnets are ring magnets.

53. The system of claim 52, wherein said first and second magnets are stacked.

54. The system of claim 52, wherein said first and second magnets are concentrically disposed.

55. The system of claim 38, wherein said microphone is disposed on top of said compliant membrane.

56. The system of claim 55, wherein said microphone is disposed on top of a plurality of compliant membranes.

57. The system of claim 55, wherein said microphone is encapsulated in a flexible substrate.

58. The system of claim 57, wherein said substrate includes a void that extends about at least a portion of a perimeter of said microphone.

59. An implantable hearing instrument, comprising:

an implant housing for housing at least one hearing aid component subcutaneously;

a microphone supported relative to said housing, said microphone being operative to receive acoustic signals and output an audio signal;

a first isolation member for compliantly supporting at least one of said housing and said microphone, wherein said first isolation member is disposed between said microphone and said housing such that said first isolation member compliantly supports said microphone; and an actuator operative to receive said audio signal and generate a stimulation signal for stimulating an auditory component of a patient.

60. The instrument of claim 59, further comprising:

a compliant base member disposed on an outside surface of said housing, wherein said compliant base member is disposed between said housing and a source of non-ambient vibration.

61. The instrument of claim 59, wherein said actuator comprises a vibratory actuator operative to mechanically vibrate in accordance with said audio output signal.

62. The instrument of claim 61, wherein said vibratory actuator vibrates an ossicle of the patient via physical engagement.

63. The instrument of claim 59, wherein said actuator comprises an acoustic actuator operative to generate an acoustic output in accordance with said audio output signal.

64. The instrument of claim 63, wherein said acoustic actuator acoustically stimulates a tympanic membrane of the patient.

65. The instrument of claim 59, wherein said actuator comprises a cochlear actuator operative to generate electrical stimulation signals in accordance with said audio output signal.

* * * * *